US006402596B1

(12) United States Patent
Hakomori et al.

(10) Patent No.: US 6,402,596 B1
(45) Date of Patent: Jun. 11, 2002

(54) SINGLE-SIDE POLISHING METHOD FOR SUBSTRATE EDGE, AND APPARATUS THEREFOR

(75) Inventors: Shunji Hakomori; Toru Asai; Noriaki Mizuno, all of Ayase (JP)

(73) Assignee: Speedfam-Ipec Co., Ltd., Ayase (JP)

( * ) Notice: Subject to any disclaimer, the term of this patent is extended or adjusted under 35 U.S.C. 154(b) by 13 days.

(21) Appl. No.: 09/644,995

(22) Filed: Aug. 24, 2000

(30) Foreign Application Priority Data

Jan. 25, 2000 (JP) ..... 2000-015510

(51) Int. Cl.[7] ..... B24B 21/12

(52) U.S. Cl. ..... 451/44; 457/41; 457/168; 457/296; 457/306

(58) Field of Search ..... 451/44, 168, 296, 451/306, 41, 42, 43

(56) References Cited

U.S. PATENT DOCUMENTS 3,715,839 A * 2/1973 Heesemann ..... 451/168
5,185,965 A * 2/1993 Ozaki ..... 451/44
5,289,661 A * 3/1994 Jones et al. ..... 451/44
5,445,554 A * 8/1995 Hosokawa ..... 451/11
5,458,529 A * 10/1995 Hasegawa et al. ..... 451/177
5,733,181 A * 3/1998 Hasegawa et al. ..... 451/44
5,866,477 A 2/1999 Ogawa et al.
6,306,016 B1 * 10/2001 Steere et al. ..... 451/44

* cited by examiner

*Primary Examiner*—George Nguyen
(74) *Attorney, Agent, or Firm*—Ohlandt, Greeley, Ruggiero & Perle, L.L.P.

(57) ABSTRACT

A single-side polishing method, and an apparatus therefor, for the upper surface and the end face of a substrate edge with a polishing strip are provided. The apparatus comprises a substrate holding member rotatably holding the substrate and a supporting a member capable of coming into contact with and retreating from the substrate holding member; a moving section pressed by a force imparting member against a single side and an end face of the substrate edge via the polishing strip is arranged so that the polishing strip polishes the side and the end face of the substrate edge upon rotation of the substrate.

7 Claims, 2 Drawing Sheets

SINGLE-SIDE POLISHING METHOD FOR SUBSTRATE EDGE, AND APPARATUS THEREFOR

BACKGROUND OF THE INVENTION

1. Field of the Invention

The present invention relates to a single-side polishing method for a substrate edge and to an apparatus therefor. More particularly, the invention relates to a single-side polishing method for mirror-polishing an edge of a disk-shaped substrate such as a semiconductor wafer, a glass plate, a quartz plate, or a ceramic substrate, which is an outer periphery of such a disk, or mirror-polishing an edge of a disk-shaped substrate having an oxide film or an insulating film on one side thereof, for removing an insulating film or the like, typically represented by an oxide film, outside the outermost pattern.

2. Description of the Related Art

A wafer used as a substrate for a semiconductor device is manufactured, for example, by slicing a single-crystal ingot such as a silicon ingot, perpendicularly to the axial direction, beveling the resultant slice, and subjecting the same to processes such as lapping, etching, annealing, and polishing.

Beveling carried out in the wafer manufacturing process as described above has a primary object of preventing chipping at the edge of the wafer, and a method of grinding off the wafer edge by means of a high-rigidity grindstone is usually adopted for beveling.

Along with the recent trend toward higher densities in semiconductor devices, however, the measures taken to prevent the generation of dust in the manufacturing process have become more strict. For the wafers, as a material therefor, the absence of dust has become an important requirement, resulting in an increasing necessity to polish the wafer edge to an extent equal to that of the mirror-polished portion of the wafer.

For a wafer having a pattern such as an oxide film or an insulating film formed on a side of the wafer, dust is produced at the oxide film or the insulating film of the one-side edge and this may exert an adverse effect. It is therefore necessary to previously eliminate the possibility of dust occurrence by removing the oxide film or the insulating film located outside the outermost pattern, and for this purpose, the upper edge of the wafer must be polished.

Known polishing apparatuses for polishing the edge of a wafer into a bevel include those disclosed in Japanese Patents Nos. 2815797 and 2889108.

The apparatus disclosed in Japanese Patent No. 2815797 has a configuration in which an arcuate polishing groove, having a radius of curvature substantially agreeing with the outer periphery of the wafer edge, is formed in a polishing buffer, and the outer periphery of the wafer, i.e., the wafer edge, is pressed into this arcuate polishing groove for polishing.

The apparatus disclosed in Japanese Patent No. 2889108 has a configuration in which a polishing tape housed in a coiled form in a rotary drum is payed out onto the peripheral surface of the rotary drum and is coiled again in the drum after passing around the drum. The wafer edge is polished at a portion of the polishing tape located on the peripheral surface of the rotary drum, and during polishing, the rotary drum is tilted at a prescribed oscillation angle in the forward/backward direction by an oscillating means.

In the apparatus disclosed in Japanese Patent No. 2815797 in which the arcuate polishing groove substantially agreeing with the wafer edge is formed in the polishing buffer itself and polishing is accomplished by pressing this arcuate polishing groove against the wafer edge, however, it is necessary to press the arcuate polishing groove against the wafer edge in a constant direction. When a shift occurs in this direction, the polishing of the wafer edge becomes unstable.

When the arcuate polishing groove is formed in the polishing buffer, it is necessary to provide a plurality of grooves because there are various beveled shapes of the wafer edges to be polished, thus requiring complicated operations.

The shape of the arcuate polishing groove is gradually worn away. Various problems therefore arise, for example, in that excessive wear may result in polishing not only of the wafer edge, but also of the flat portion of the wafer.

In the apparatus disclosed in Japanese Patent No. 2889108, on the other hand, it is necessary to tilt the rotary drum in the forward/backward direction during polishing, requiring a complicated tilting mechanism to produce this tilting. Other problems are the large size of the apparatus itself and higher cost.

There is also available an apparatus in which grooves of various sizes are arranged in the polishing strip located outside the supporting section, and polishing is conducted by pressing the wafer edge against an appropriate groove. In this apparatus, the shape of the groove may be changed by polishing, resulting in disagreement between the groove and the wafer edge, thus making it impossible to carry out satisfactory polishing.

All the aforementioned apparatuses are designed to simultaneously polish the upper and lower sides of the wafer edge, and they are not therefore suitable for polishing only a single side of the wafer edge.

Japanese Unexamined Patent Application Publication No. 7-193030 discloses an apparatus using a polishing strip not having a groove formed thereon. In this apparatus, only a single side of wafer can be polished by removing a lower side driving roller. However, because grinding grains are embedded in the polishing strip, the wafer is not polished but ground by moving the polishing strip provided with these grinding grains relative to the wafer edge. It is therefore necessary to continuously move the polishing strip during grinding. Upon discontinuation of movement, therefore, the grinding grains coming into contact with the wafer at that moment, leaving grinding marks. In order to remove the polysilicon film, the configuration must be as described above.

In the apparatus proposed in the present invention, in contrast, having a configuration in which a substrate edge is polished, grinding grains are not embedded in the polishing strip itself, and the polishing strip is stopped during polishing. Thus, the object of the invention is quite different from the object of the aforementioned Japanese Unexamined Patent Application Publication No. 7-193030.

The conventional apparatuses have various problems as described above, and furthermore, it is necessary to mirror-finish the entire surface of a wafer by a polishing apparatus. It is therefore necessary to reduce portions in contact with the wafer on the supporting mechanism supporting the wafer itself, and to minimize the contact portions when supporting the wafer.

SUMMARY OF THE INVENTION

The present invention has as an object to provide a single-side polishing method for a substrate edge and an apparatus therefor, which permit polishing of an edge of a substrate by pressing a polishing strip (a narrow pad) against the edge of the substrate such as a wafer to be polished, and do not require tilting of the substrate during polishing, thus eliminating the necessity of a tilting mechanism, and allow reduction in size of the overall apparatus and lower cost.

Another object of the invention is to provide a single-side polishing method for a substrate edge and an apparatus therefor which permit polishing of an edge of a substrate by pressing a polishing strip (a narrow pad) against the edge of the substrate, such as a wafer, to be polished, and do not require tilting of the substrate during polishing, thus eliminating the necessity of a tilting mechanism, and allow reduction in size of the overall apparatus and lower cost, and which make it possible to adjust the pressing force acting during polishing of the substrate edge to achieve a desired polished condition, and to ensure polishing of a desired portion even when a pattern such as an oxide film or an insulating film is formed on a single side.

To achieve the above-mentioned objects, the invention provides a single-side polishing method for a substrate edge, comprising the steps of bringing a moving section having a surface coming into contact with a substrate edge in the presence of a polishing strip and given a force by a force imparting member with a side of the substrate edge rotatably held by a substrate holding member, to press the polishing strip against the side and an end face of the substrate edge, and rotate the substrate for polishing the side and the end face of the substrate.

The invention provides a single-side polishing apparatus for a substrate edge, comprising a substrate holding member rotatably holding a substrate, and a supporting member capable of relatively coming into contact with and retreating from the substrate holding member, wherein a moving section coming into contact with a single side and an end face of the substrate edge in the presence of a polishing strip is additionally provided.

The invention provides another single-side polishing apparatus for a substrate edge, comprising a substrate holding member rotatably holding a substrate, and a supporting member capable of relatively coming into contact with and retreating from the substrate holding member, wherein the supporting member comprises a fixing section to the substrate and a vertically movable moving section; the moving section, given a force by a force imparting member, is capable of coming into contact with a side of the substrate edge; and furthermore, a polishing strip, positioned between the moving section and the substrate, comes into contact with the side and an end face of the substrate edge.

In the apparatus of the invention, the polishing strip is located on one side of the moving section when it is wound and stretched to cause the end to be sequentially payed out, and after covering the lower surface of the leading end of the moving section, the end is positioned on the other side of the moving section and is sequentially taken up, and paying-out and coiling of the polishing strip are discontinued during polishing when it is pressed against the substrate edge and the lower surface of the moving section.

Since the above-mentioned means are adopted in the present invention, and as a result, a side and an end face of the edge of the substrate rotate while pressing the polishing strip provided on the supporting member, the side and the end face of the substrate edge are certainly polished by the polishing strip.

Furthermore, because the polishing strip is pressed by the moving section give a force by the force imparting member, a portion of the substrate edge can be polished in response to the shape of the moving section.

The polishing strip can be payed out and coiled. New portions of the polishing strip can therefore be brought into contact with the substrate edge for polishing by discontinuing movement of the polishing strip, and paying out and coiling it during non-polishing periods.

DESCRIPTION OF THE PREFERRED EMBODIMENTS

Embodiments of the present invention will now be described with reference to the drawings.

Figure 1:
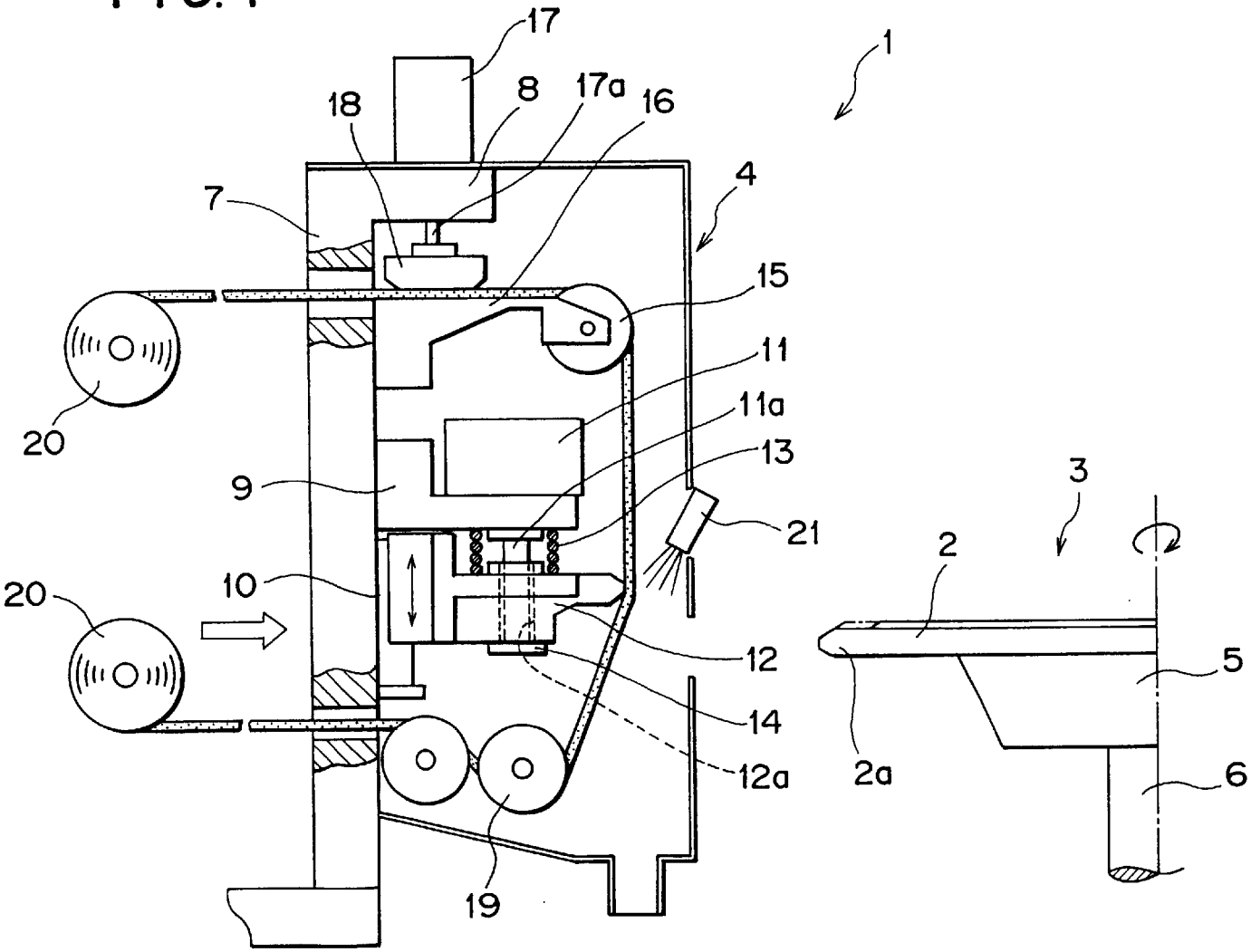
FIG. 1 is a schematic view of a single-side polishing apparatus for a substrate edge, illustrating an embodiment of the present invention, and a schematic view illustrating a separated state of the supporting member and the polishing member.
Figure 2:
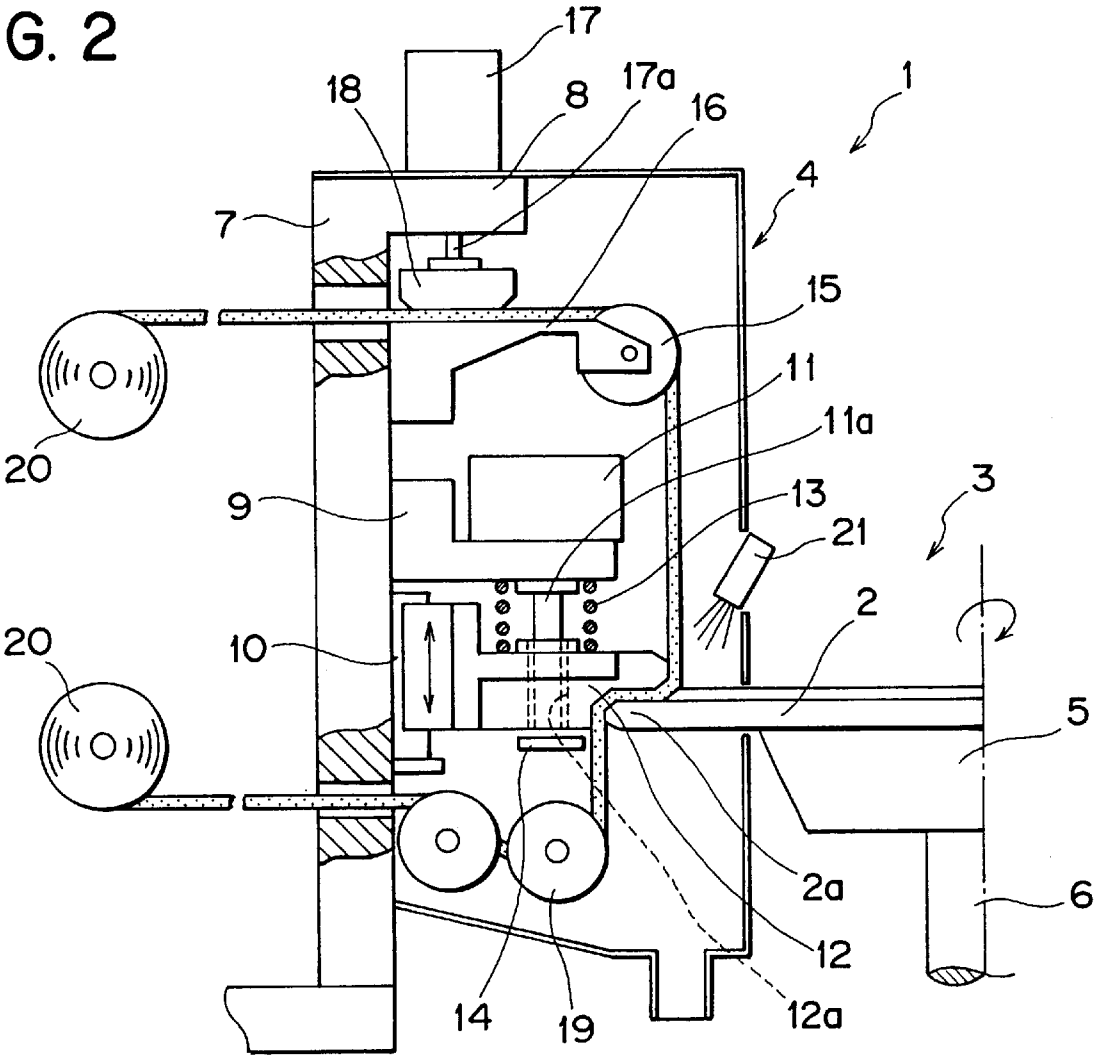
FIG. 2 is a schematic view illustrating a state in which a side and an end face of an edge of a substrate is polished by a holding member as a result of movement of the supporting member.

The drawings illustrate the single-side polishing apparatus of a substrate edge of the invention. FIG. 1 is a schematic view illustrating a state in which the supporting member is separated from the holding member; and FIG. 2 is a schematic view illustrating a state in which a side and an end face of an edge of a substrate is polished by a holding member as a result of movement of the supporting member.

The aforementioned single-side polishing apparatus 1 of the substrate edge comprises a wafer holding member 3 which rotatably holds, for example, a semiconductor wafer 2 (hereinafter referred to as a "wafer") in a horizontal orientation by the use of means such as vacuum chucking, and a supporting member 4 separably provided which moves horizontally relative to the rotation center axis of the wafer holding member 3.

The wafer holding member 3 is located substantially at the center of the polishing apparatus, and comprises a holding section 5 which attracts the wafer 2 transferred from a transfer member (not shown), and a rotation driving section 6 which rotates the holding section 5 horizontally by a driving source (not shown).

The supporting member 4 has an inward projection 8 integrally formed at an upper portion of a vertically upright base 7. A fixing section 9 and a guiding section 10 located under the fixing section 9 are provided on an inner side surface of the base 7, and a cylinder 11 is arranged on the fixing section 9 so that an operating section 11*a* of this cylinder 11 runs up and down through the fixing section 9.

The guiding section 10 has, on the other hand, a moving section 12 guiding a polishing strip 20 at the leading end thereof, which is arranged so as to be vertically movable.

A spring 13 serving as a force imparting member is arranged between the moving section 12 and the fixing section 9. The operating section 11*a* of the cylinder 11 passes through a hole 12*a* provided in the moving section 12, and the spring 13 is retained in a compressed state by a stopper section 14 provided on the leading end of the operating section 11*a*. The moving section 12 is therefore held in a state in which movement thereof is prevented by the stopper section 14 against the force imparting function of the spring 13.

A guiding section 16 having a roller 15 provided at the leading end thereof is integrally provided on the base 7 above the fixing section 9. A cylinder 17 is provided in the aforementioned projection 8 located in the upper portion of this guiding section 16. A pressing section 18, capable of being pressed against the upper surface of the guiding section 16, is provided in an operating section 17*a* of this cylinder 17.

A pair of guide rollers 19 are arranged under the moving section 12, and polishing strips 20 and 20 are provided, on the other hand, at positions corresponding to the roller 15 and the guide rollers 19 so as to be capable of being payed off and coiled, outside the supporting member 4.

The supporting member 22 is moved by a horizontal moving source (not shown) toward the rotational center of the wafer holding member 3 from the state separated from the wafer holding member 3 to the state approaching the same, thus causing the polishing strip 20 to come into contact with the upper surface (including the bevel) and the end face of the edge 2*a* of the wafer 2.

The polishing strip 20 extends so as to be capable of being payed off and spooled up via the pair of guide rollers 19, the leading end of the moving section 12 and the roller 15, and is held and fixed between the guiding section 16 and a pressing section 18.

Reference numeral 21 indicates a nozzle for supplying slurry to the edge 2*a* of the wafer 2. Supply of slurry in this manner makes it possible to further improve the condition of polishing.

The operation of the above-mentioned components will now be described.

In the polishing apparatus having the configuration as described above, the wafer 2 is first transferred by the transfer member (not shown) and is passed to the wafer holding member 3.

The wafer holding member 3 holds the transferred wafer 2 on the upper surface of the holding section 5 by means such as vacuum chucking, and then the holding section 5 is rotated around the axis of the rotational driving section 6 by a driving source. Since a side of the wafer 2 is held, leading to a slight area of contact with the wafer holding member 3, there is no risk of marking.

On the other hand, the supporting member 4 is moved by a horizontal moving source (not shown) from a state separated from the wafer holding member 3 to a state approaching the same toward the axial rotation center of the wafer holding member 3. In other words, the edge 2*a* of the wafer 2 moves into the supporting member 4 to reach a position below the moving section 12 while pressing the polishing strip 20 at an end of the edge 2*a,* and stops in this state.

When the operating section 11*a* is caused to project by actuating the cylinder 11, the moving section 12 moves down under the effect of the force imparted by the spring 13. In this state, therefore, the polishing strip 20 is in contact with the upper surface and the end face of the edge 2*a* of the wafer 2, and furthermore, it is pressed by the spring 13 serving as a force imparting member.

Upon rotation of the rotational driving section 6 of the wafer holding member 3, the edge 2*a* of the wafer 2 is polished by friction with the pressed portion of the polishing strip 20.

Therefore, even when an oxide film or an insulating film is formed as a pattern on the upper surface, the insulating film or the like outside the outermost pattern can be removed merely by bringing it into contact with the polishing strip 20, and the extent of the removed portion outside the outermost pattern depends upon the shape of the lower side of the moving section.

When the portion of the polishing strip 20 used for polishing has worn out, it suffices to spool the polishing strip in one direction to position a new portion under the leading end of the moving section 12 to conduct a new polishing run.

Since it is possible to always polish the edge 2*a* of the wafer with the polishing strip 20 in optimum condition, satisfactory polishing of the edge 2*a* can be ensured.

In this case, various methods may be adopted, including spooling the polishing strip 20 every prescribed period of time, or spooling the polishing strip 20 after a prescribed number of turns of the wafer holding member 3.

The condition of polishing can also be improved by supplying slurry from a nozzle 21 to the edge 2*a* of the wafer 2.

Furthermore, paying off of the polishing strip 20 may be discontinued during polishing, or it may be payed out upon wearing to a certain extent to expose a new portion, or the polishing strip may be payed out intermittently by a prescribed pitch for each run of polishing operation. For these operations, any of various known practices may be adopted.

It is thus possible to use the polishing strip 20 at a high efficiency and reduce the cost by the use of these variants of operation.

When using the configuration as shown in the aforementioned embodiment, the lower side itself of the moving section 12 agrees with the shape of the edge 2*a* of the wafer 2 merely by pressing the polishing strip against the edge 2*a* of the wafer 2. It is therefore possible to accomplish polishing by certainly pressing the polishing strip 20 against the edge 2*a* of the wafer 2 without tilting the edge 2*a* of the wafer 2.

Even when the edge 2*a* of the wafer 2 is round or is trapezoidal, it is therefore possible to accomplish polishing while the polishing strip 20 certainly presses the edge 2*a* of the wafer 2 by ensuring that the lower side itself of the leading end of the moving section 12 agrees therewith.

In the above-mentioned embodiment, the supporting member 4 supporting the polishing strip 20 is brought into contact with and is separated from the wafer holding member 3 supporting the wafer 2. This may, however, be reversed. For the moving mechanism for bringing it into contact with and separating therefrom, any of various known mechanisms may be adopted, including a mechanism of using a wire and a balance weight on the moving member side and moving the moving member by this balance weight, or a mechanism of returning it to the original state by the use of the cylinder 11.

The polishing time can be remarkably reduced by using a configuration in which a plurality of supporting members 4 are previously provided, and upon polishing, all the supporting members 4 come close to the edge 2*a* of the wafer 2 for polishing.

According to the method of the present invention using the configuration as described above, the upper surface and the end face of the substrate edge is pressed by the polishing strip capable of being sequentially payed out, and the substrate is rotated in this state. Polishing of the upper surface and the end face of the substrate edge is thus ensured. The possibility of exposing a new portion of the polishing strip upon wear of the polishing strip brings about a higher polishing efficiency.

According to the apparatus of the invention, the upper surface and the end face of the substrate edge can be polished by pressing the polishing strip via the lower side of the moving section of the supporting member.

Furthermore, according to the apparatus of the invention, the lower side of the moving section presses the polishing strip against the substrate edge with a prescribed force imparted by the force imparting member. It is therefore possible to ensure polishing of the upper surface and the end face of the substrate edge.

Upon wear of the polishing strip, a new portion of the polishing strip can be sequentially exposed, all portion of the polishing strip can be used, thus making it possible to reduce the manufacturing cost and the operating cost.

Even when the substrate edge has a round or trapezoidal shape, the polishing strip can accurately press and polish the upper surface and the end face of the substrate edge by adopting a configuration in which the shape of the lower side of the moving section agrees with the edge shape.

What is claimed is:

1. A single-side polishing method for a substrate edge of a substrate, comprising the steps of bringing a moving section having a surface into contact with said substrate edge with a polishing strip disposed therebetween, applying a force by a force imparting member to press the polishing strip against a side and an end face of said substrate edge, and rotating said substrate for polishing said side and said end face.

2. a single-side polishing apparatus for a substrate edge of a substrate, comprising:

a substrate holding member for rotatably holding said substrate; and a supporting member moving relatively into contact with and retreating from said substrate holding member, said supporting member have a moving section that comes into contact with a single side and an end face of said substrate edge with a polishing strip disposed therebetween.

3. A single-side polishing apparatus for a substrate edge according to claim 2, wherein said polishing strip is located on one side of said moving section when it is wound and stretched to cause the end to be sequentially payed out, and after covering the lower surface of the leading end of the moving section, the end is positioned on the other side of the moving section and sequentially taken up.

4. A single-side polishing apparatus for a substrate edge according to claim 3, wherein paying-out and spooling of said polishing strip are discontinued during polishing when the strip is pressed against said substrate edge and the lower surface of the moving section.

5. A single-side polishing apparatus for a substrate edge, comprising:

a substrate holding member for rotatably holding a substrate;

a supporting member capable of moving relatively into contact with and retreating from said substrate holding member, said supporting member comprises a fixing section to the substrate and a vertically movable moving section, said moving section, given a force by a force imparting member, is capable of coming into contact with a side of the substrate edge; and a polishing strip, positioned between said moving section and the substrate, for contacting the side and an end face of the substrate edge.

6. A single-side polishing apparatus for a substrate edge according to claim 5, wherein said polishing strip is located on one side of said moving section when it is wound and stretched to cause the end to be sequentially payed out, and after covering the lower surface of the leading end of the moving section, the end is positioned on the other side of the moving section and sequentially taken up.

7. A single-side polishing apparatus for a substrate edge according to claim 6, wherein paying-out and spooling of said polishing strip are discontinued during polishing when the strip is pressed against said substrate edge and the lower surface of the moving section.

* * * * *